United States Patent [19]

Cowan et al.

[11] Patent Number: 4,991,878

[45] Date of Patent: Feb. 12, 1991

[54] LABEL ASSEMBLY WITH REMOVABLE BOOKLET

[75] Inventors: Randy G. Cowan; Richard J. Donovan; Barron G. McKillip, all of Sioux Falls, S. Dak.

[73] Assignee: CCL Product Identification, Inc., Grand Rapids, Mich.

[21] Appl. No.: 521,574

[22] Filed: May 10, 1990

[51] Int. Cl.[5] ..... B42D 15/00

[52] U.S. Cl. ..... 283/81; 40/638; 428/40; 283/100; 283/101; 283/107

[58] Field of Search ..... 283/81, 105, 99, 101; 428/40, 41, 42; 229/70, 71; 206/632

[56] References Cited

U.S. PATENT DOCUMENTS

| | | | |
|---|---|---|---|
| 3,854,229 | 12/1974 | Morgan | 40/638 |
| 4,068,028 | 1/1978 | Samonides | 428/40 |
| 4,526,405 | 7/1985 | Hattemer | 40/638 |
| 4,671,003 | 6/1987 | Vitol | 40/638 |
| 4,890,862 | 1/1990 | Buchholz | 283/81 |
| 4,940,258 | 7/1990 | Cuba, Jr. et al. | 283/81 |

*Primary Examiner*—Douglas D. Watts
*Assistant Examiner*—Hwei-Siu Payer
*Attorney, Agent, or Firm*—Warner, Norcross & Judd

[57] ABSTRACT

A label assembly includes a base label, informational material, and a clear over-laminate sheet. The informational material is completely encased between the clear over-laminate sheet and the base label by sealing the marginal edges of the sheet to the outer portions of the base label. The front sheet of the informational material and the front surface of the base label are provided with identical indicia. In use, the label is attached to the product such that the front sheet of the informational material is clearly visible through the clear over-laminate sheet to properly mark the product before its sale. After the product is sold, the end user may remove the clear over-laminate sheet to gain access to the information material provide therein. Once the over-laminate sheet and informational material have been removed, the indicia printed on the base label functions to properly mark the product.

20 Claims, 2 Drawing Sheets

LABEL ASSEMBLY WITH REMOVABLE BOOKLET

BACKGROUND OF THE INVENTION

The present invention pertains to a label assembly with a removable booklet.

Many products are sold with various informational packets relating to warranties, operational instructions, label requirements, or other matters. The informational literature is often loosely received within a carton or other packaging along with the particular product. Although this approach may be sufficient in certain instances, it does involve a risk that the information will become separated from the product before being purchased by the ultimate consumer. Moreover, this method has no applicability to the many products which are frequently displayed or sold without an additional carton or box.

Alternatively, the informational packets may be incorporated into the label assembly used to mark the product. Examples of such constructions include: U.S. Pat. No. 4,846,504 to MacGregor, entitled SECURE ON-PACK PROMOTIONAL COUPONS; U.S. Pat. No. 4,711,686 to Instance, entitled METHOD OF MAKING LABELS; U.S. Pat. No. 4,621,837 to Mack, entitled MULTI-LAYERED LABEL; and U.S. Pat. No. 1,273,105 to Van Dyke, entitled LABEL. However, these assemblies are all lacking in versatility by requiring that the informational packet be of a specific format. Moreover, many of the labels are constructed such that accessing the information either destroys the labeling or at the least creates an unsightly resultant label. Additionally, most of these assemblies are either not securely fastened to the product or lack sufficient protection to ensure that the informational material will not be damaged before removal by the ultimate consumer.

SUMMARY OF THE INVENTION

The aforementioned problems are overcome in the present invention, wherein a label assembly securely and aesthetically provides a combined label and informational packet.

More specifically, the label assembly includes a printed base label, informational material, and a clear over-laminate sheet. The over-laminate sheet is adhered along its marginal edges to the base label, forming a completely enclosed pocket within which the informational material is positioned. The front of the informational material and the base label are printed with substantially similar indicia, so that the informational material serves to mark the product prior to its purchase, and the base label functions to mark the product after the informational material has been accessed.

This unique assembly enables virtually any style of informational material to be provided within the defined pocket. Moreover, the information is suitably protected against loss or damage by the peripheral seal. The seal is selected to enable the over-laminate sheet to be removed from the base label without leaving a sticky residue or creating a resultant unsightly label. The label assembly is as equally readable and aesthetically pleasing after the informational material has been accessed as it is before.

These and other objects, advantages, and features of the present invention will be more fully understood and appreciated by reference to the written specification and appended drawings.

DETAILED DESCRIPTION OF THE PREFERRED EMBODIMENT

Figure 1:
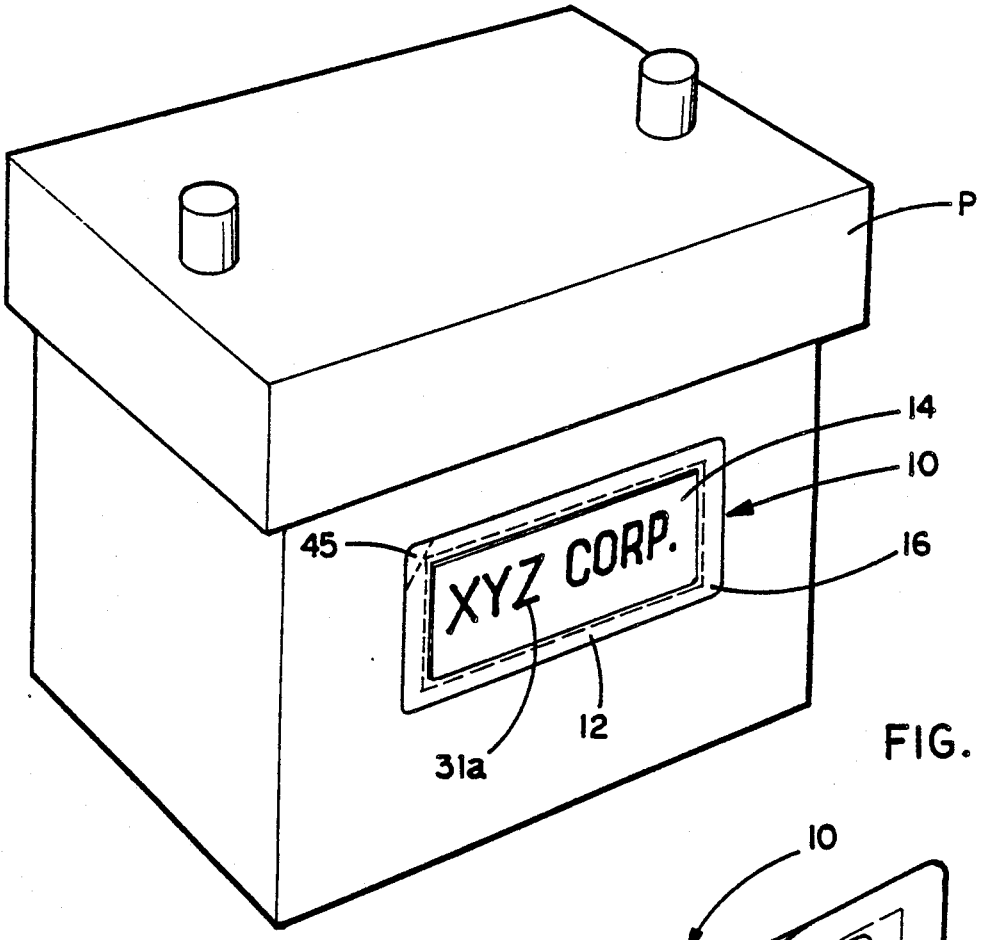
FIG. 1 is a perspective view of the present label assembly affixed to a product.
Figure 2:
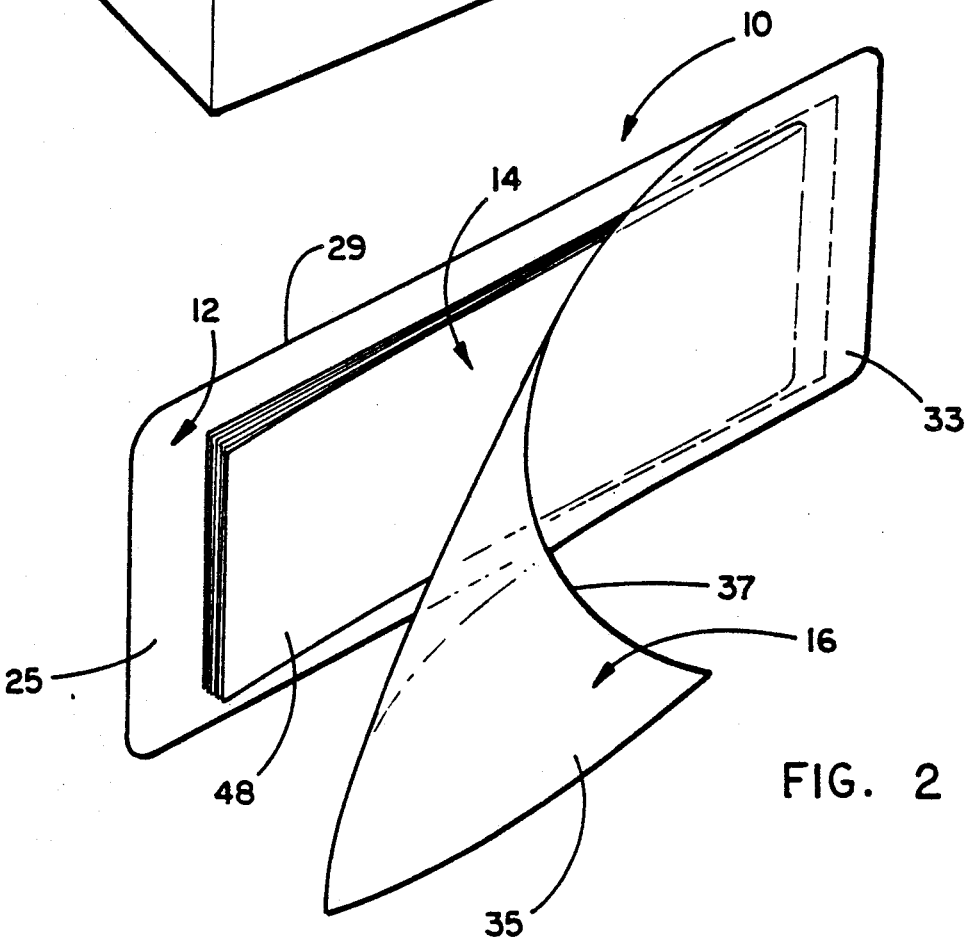
FIG. 2 is a perspective view of the label assembly with the over-laminate sheet partially removed.
Figure 6:
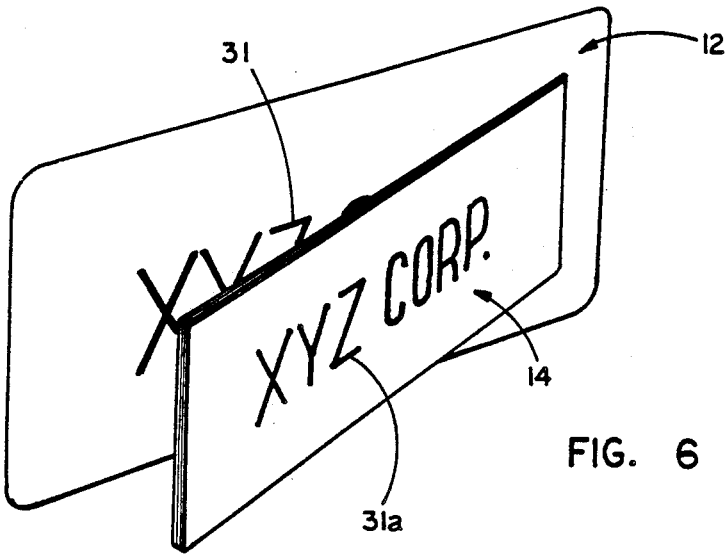
FIG. 6 is a perspective view of the label assembly with the over-laminate sheet removed and the informational material pulled outward.

The label assembly of the preferred embodiment is illustrated in the drawings and generally designated 10. Label assembly 10 includes a base label 12, informational material 14, and an over-laminate sheet 16.

Figure 4:
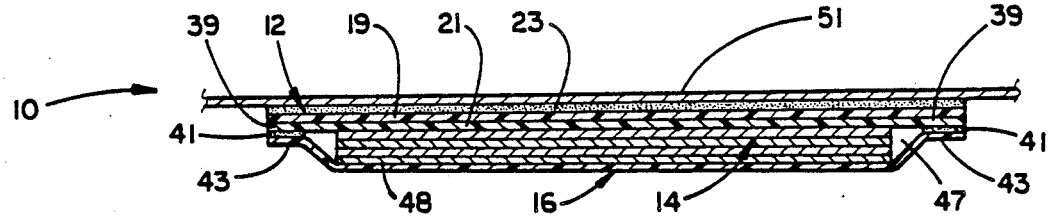
FIG. 4 is a cross-sectional view taken along line IV—IV in FIG. 3.
Figure 5:
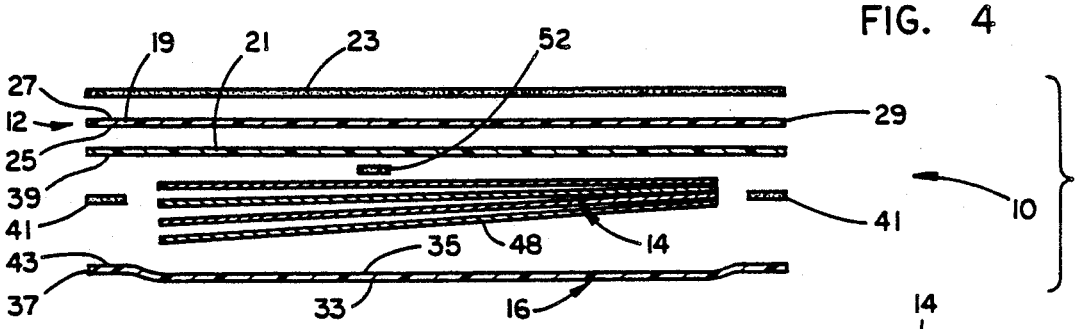
FIG. 5 is an exploded cross-sectional view of the label assembly.
Figure 3:
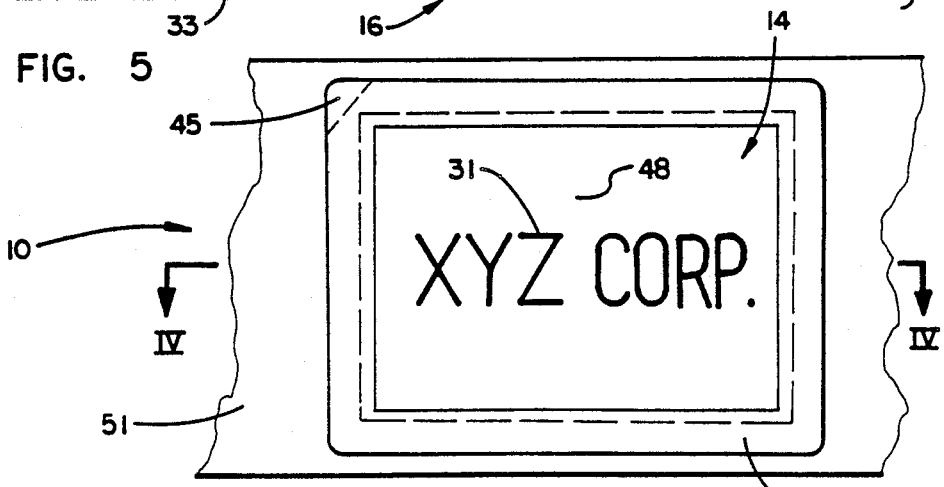
FIG. 3 is a top plan view of a label assembly.

Base label 12 (FIGS. 4 and 5) includes a primary layer 19, a clear over-laminate film 21, and a layer of pressure sensitive adhesive 23. Primary layer 19 is a thin, generally rectangular sheet having front and rear surfaces 25, 27 and a peripheral edge 29. Primary layer 19 is preferably composed of a white polystyrene material, although other materials and/or colors could be used. The base label 12 can be opaque, translucent, or transparent. The over-laminate film 21 could be replaced by a plastic or varnish coating to provide clean removal of the over-laminate 16 as will be described.

Front surface 25 is preferably printed with indicia 31 which functions as a label for the product after its purchase, as will be more fully described below. To protect primary layer 19 and any indicia 31 printed thereon, front surface 25 is overlaid with a clear, over-laminate film 21. Film 21 is applied as a coating to primary layer 19 so that it is permanently affixed thereto. Film 21 is preferably composed of a polyester material, but could be composed of other materials meeting the requisite characteristics.

A pressure-sensitive adhesive 23 is applied to rear surface 27 of primary layer 19. Adhesive 23 is provided to fixedly attach primary layer 19 to the product throughout its useful life. The adhesives to be used are conventional, and will depend on the material of the products being marked and the environment to which the label will be subjected. S-730 produced by Fasson of Painesville is one example of an adhesive which could be used to adhere the base label 12 to a plastic surface.

Label assembly 10 further includes a transparent over-laminate sheet 16. Translucent or opaque materials could also be used. Sheet 16 has a substantially rectangular configuration similar to base label 12. Sheet 16 is preferably composed of polypropylene, but could of course be composed of other materials. Over-laminate sheet 16 includes front and rear faces 33, 35 and a peripheral edge 37.

The marginal portions 43 of rear face 35 of sheet 16 are provided with an adhesive 41. A heat-activated adhesive sold in the form of strips as E-4090 by Pierce And Stevens of Buffalo, N.Y. is one example of adhesive which may be used. Strips 41 are heat sealed to secure marginal portions 43 to perimeter portions 39 of the film 21, such that peripheral edges 29, 37 of base label 12 and sheet 16 are substantially aligned. Adhesive strips 41 seal substantially the entire peripheral portions of the sheet 16 and film 21 together. The over-laminate sheet 16 and base label 12 collectively define a central pocket 47 therebetween to receive informational material 14. Alternate adhesives may be used. Preferably, the adhesive releases cleanly from the base label 12 so as to leave little or no residue on the base label when the over-laminate 16 is removed. For example, conventional pressure-sensitive adhesives could be used.

One corner of label assembly 10 is provided with a triangular tab portion 45 which includes no adhesive 41 to facilitate easy removal of sheet 16 from base label 12. Specifically, tab 45 provides a portion which may be easily grasped and pulled to remove over-laminate sheet 16. Tab 45 may further include indicia (not shown), such as "Lift Here", to direct the user on opening the assembly. Further, the plastic-to-plastic heat seal provides no residual adhesive to the film 21, nor any tearing or fracturing of the over-laminate sheet 16 when it is removed from base label 12.

Informational material 14 may include any material to be passed to the user along with the product such as, instructional material warranty cards, coupons, advertisements, catalogs, or other substantially planar items irrespective of whether they are printed paper products. Consequently, informational material 14 may be of many different forms, such as a booklet (as shown in the drawings), a folded sheet of paper, a plurality of unattached sheets, or any other format which may be desired. This wide variety is accomplished by completely surrounding pocket 47, to thereby hold and protect any type of material. The physical volume of information which may be included is of course limited to the size of the pocket 47. Nevertheless, a certain amount of variation is possible. In other words, the size of the pocket 47 may be adjusted to accommodate different sized packets of informational material 14.

The front sheet or other exposed surface 48 of the material 14 is printed with indicia 31*a*. Indicia 31*a* is oriented to be seen through over-laminate sheet 16 (if transparent) to act as a label to mark the product P before its purchase. For example the indicia 31 and 31*a* might both prominently display a trademark, slogan, or graphic design. In the preferred embodiment, indicia 31*a* is substantially similar, and preferably identical, to indicia 31 so that the product bears substantially the same information, regardless of whether the informational material has been removed. Although, over-laminate sheet 16 holds the material 14 in place, a small quantity of conventional pressure-sensitive adhesive 52 may be applied to the central portion of film 21 to positively adhere the material 14 in place.

In use, label assembly 10 is removed from a strip of backing material 51 and attached to its corresponding product P. In the illustrated example (FIG. 1), label assembly 10 is attached to a battery P. As can be seen, the product is labeled with the proper markings by the front sheet 48 of the informational material 14 visible through the over-laminate. Front sheet 48 is held in place and protected by sheet 16, which is sealed around substantially the entire periphery of base label 12. As can be readily appreciated, sheet 16 completely encapsulates the booklet 14 and ensures that none of the material is lost or damaged prior to positive removal by the consumer.

Once the product is purchased, the consumer grasps and pulls tab 45 upwardly or outwardly to separate the over-laminate sheet 16 from base label 12. Heat-sealed adhesive strips 41 leave substantially no residue on base label 12 once sheet 16 has been removed. With the removal of sheet 16, informational material 14 is accessed by the end consumer for his use. The residue of adhesive 52, if any, which may remain from securing booklet 14 to base label 12 will be substantially clear to avoid blocking indicia 31 on the base label 12. Further, adhesive 52 may generally be easily removed by simple rubbing. Once over-laminate sheet 16 and informational packet 14 have been removed, base label 12 functions as the primary label for the product through the remainder of its useful life.

The above description is that of a preferred embodiment of the invention. Various alterations and changes can be made without departing from the spirit and broader aspects of the invention as set forth in the appended claims, which are to be interpreted in accordance with the principles of patent law including the Doctrine of Equivalents.

The embodiments of the invention in which an exclusive property or privilege is claimed are defined as follows:

1. A label assembly for use in marking a product and supplying informational material, said label assembly comprising:

a base label defining front and rear surfaces, said front surface having a first indicia thereon and said rear surface having a first adhesive applied thereto to affix said base label to a product;

an over-laminate sheet adapted to overlie said base label;

a second adhesive applied between said base label and said over-laminate sheet to releasably affix said over-laminate sheet to said base label and define a pocket therebetween, said second adhesive being cleanly removable from said base label when said over-laminate is removed therefrom; and informational material defining a front cover portion, said informational material being located within said pocket, said front cover portion being visible through said over-laminate sheet and having a second indicia printed thereon, such that said second indicia functions to mark the product while said over-laminate sheet is affixed to said base label, and said first indicia functions to mark the product after the removal of said over-laminate sheet and informational material.

2. A label assembly as defined in claim 1 in which said front surface of said base label further includes a plastic coating to protect said base label and said first indicia.

3. A label assembly as defined in claim 2 wherein said over-laminate sheet is a plastic material, wherein said second adhesive is heat sealed between said over-laminate sheet and said plastic coating, and wherein said second adhesive leaves substantially no adhesive residue on said plastic coating when said over-laminate sheet is removed.

4. A label assembly as defined in claim 3 in which said base label and said over-laminate sheet each define a perimeter portion, and wherein said second adhesive is positioned around substantially said entire perimeter portions of said base label and said over-laminate sheet.

5. A label assembly as defined in claim 4 in which said perimeter of said over-laminate sheet includes a tab portion not adhered to said base label, and wherein said tab portion is adapted to be manually grasped and pulled to remove said over-laminate sheet from said base label.

6. A label assembly as defined in claim 1 in which said base label and said over-laminate sheet each define a periphery, and wherein said second adhesive material is positioned around the entire peripheries of said base label and said over-laminate sheet.

7. A label assembly as defined in claim 1 wherein said first and second indicia are substantially identical to one another.

8. A label assembly comprising:

a base label defining a front surface and a rear surface, said rear surface having a first adhesive thereon to affix said base label to an object;

an over-laminate sheet overlying said front surface of said base label and releasably affixed about a peripheral portion to said base label such that a pocket is defined therebetween, said over-laminate being releasably affixed to said base label by a second adhesive that leaves substantially no residue on said base label as said over-laminate is removed; and material within said pocket, said material including at least one substantially planar element.

9. A label assembly as defined in claim 8 in which said pocket is structured so that it has the capacity to receive and hold material in a plurality of different formats including either of (i) a plurality of substantially planar elements attached to one another and (ii) a plurality of substantially planar elements unattached to one another.

10. A label assembly as defined in claim 8 further comprising an adhesive affixing said over-laminate surrounding and enclosing said material to said base label to hold and protect said material within said pocket.

11. A label assembly as defined in claim 8 wherein said front surface of said base label includes first indicia thereon, wherein said material includes a front cover portion visible through said over-laminate sheet, wherein said front cover portion includes second indicia thereon, wherein said front cover portion marks the product when said over-laminate sheet is attached to said base label, and wherein said base label marks the product after said over-laminate sheet and material have been removed.

12. A label assembly as defined in claim 11 wherein said first and second indicia are substantially identical to one another.

13. A label assembly as defined in claim 11 wherein said front surface of said base label includes a plastic coating to protect said base label and indicia thereon.

14. A label assembly as defined in claim 13 wherein said over-laminate sheet is a plastic material, wherein said second adhesive is heat sealed between said over-laminate sheet and said plastic coating, and wherein said second adhesive leaves substantially no adhesive residue on said plastic coating when said over-laminate sheet is removed.

15. A label assembly for use in marking a product and supplying informational material, said label assembly comprising:

a base label composite including a primary layer defining a front surface and a rear surface, a first adhesive applied to said rear surface of said primary layer to affix said base label to a product;

an over-laminate sheet overlying said base label;

a second adhesive releasably attaching said over-laminate sheet to said front surface to define a pocket therebetween, said second adhesive adhering to said over-laminate upon its removal from said base label so as to leave little or no residue on said base label; and informational material in said pocket.

16. A label assembly as defined in claim 15 in which said second adhesive is heat sensitive so that said over-laminate sheet is heat sealed to said plastic coating such that substantially no residue remains on said coating after said sheet is removed therefrom.

17. A label assembly as defined in claim 15 wherein said front surface of said primary layer includes a first indicia thereon, wherein said informational material includes a front cover portion visible through said over-laminate sheet, wherein said front cover portion includes second indicia thereon, wherein said front cover portion marks the product while said over-laminate sheet is attached to said base label, and wherein said base label marks the product after said over-laminate sheet and informational material have been removed.

18. A label assembly as defined in claim 17 wherein said first and second indicia are substantially identical to one another.

19. A label assembly as defined in claim 15 in which said second adhesive completely surrounds and encloses said informational material to hold and protect it within said pocket.

20. A label assembly as defined in claim 15 wherein said base label and said over-laminate sheet each define a peripheral edge, wherein said second adhesive is positioned around substantially the entire peripheral edges of said over-laminate sheet and said base label, wherein said peripheral edge of said over-laminate sheet includes a tab portion not adhered to said base label, and wherein said tab portion is adapted to be manually grasped and pulled to remove said over-laminate sheet from said base label.

* * * * *